US007503561B2

(12) United States Patent
Totsuka et al.

(10) Patent No.: US 7,503,561 B2
(45) Date of Patent: Mar. 17, 2009

(54) METHODS AND DEVICES FOR DETECTING THE ABSENCE OF A MEDIA SHEET WITHIN AN IMAGE FORMING DEVICE

(75) Inventors: Kenji Totsuka, Lexington, KY (US); John Spicer, Lexington, KY (US); Franklin Joseph Palumbo, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/741,788

(22) Filed: Apr. 30, 2007

(65) Prior Publication Data

US 2008/0267639 A1 Oct. 30, 2008

(51) Int. Cl.
*B65H 7/04* (2006.01)

(52) U.S. Cl. ..... 271/265.01; 271/110

(58) Field of Classification Search ..... 271/110, 271/258.01, 259, 258.03, 258.04, 265.01, 271/265.02, 10.02, 10.03
See application file for complete search history.

(56) References Cited

U.S. PATENT DOCUMENTS 6,572,096 B1 * 6/2003 Johnson et al. ..... 271/25
2003/0067108 A1 * 4/2003 Marra et al. ..... 271/10.01

* cited by examiner

*Primary Examiner*—Patrick H Mackey
*Assistant Examiner*—Ernesto Suarez

(57) ABSTRACT

The present application is directed to methods and devices for determining the absence of media sheets within an image forming device. In one embodiment, a support section configured to hold a stack of media sheets is positioned in an input area of the image forming device. A pick mechanism is positioned to contact a top-most sheet in the support section. The pick mechanism may include a pick motor and a pick roller. A sensor roller may be positioned to contact the top-most media sheet at a position spaced away from the pick roller. A controller may determine the absence of a media sheet based on the movement of the sensor roller after a predetermined movement of the pick motor.

17 Claims, 9 Drawing Sheets

METHODS AND DEVICES FOR DETECTING THE ABSENCE OF A MEDIA SHEET WITHIN AN IMAGE FORMING DEVICE

BACKGROUND

The present application is directed to methods and devices for controlling operation of an image forming device and, more specifically, to methods and devices for detecting when no media is present in an input area.

An image forming device, such as a color laser printer facsimile machine, copier, all-in-one device, etc, includes a media feed system for introducing and using media sheets. The media feed system includes an input area where media sheets am initially placed prior to being introduced into a media path. A pick mechanism may also be located in the input area to contact and move a media sheet from the input area and into the media path.

The media feed system may also detect when there is no media in the media feed system. Detecting the presence of media may involve the use of sensors to monitor components of the media feed system. Additional sensors or mechanisms may also be included to facilitate media defection, including those necessary to detect movement of the media.

New image forming devices are trending towards lower cost, smaller height/footprint, and higher print quality. The smaller sizes have various advantages including that the devices fit within a smaller workspace and a reduction in shipping and packaging costs. One way to reduce both cost and size is to eliminate some of the parts. Parts may be eliminated by using an existing pant to perform more than one function. The media feed system may include a number of similar sensors and mechanisms. Therefore, opportunities may exist, to eliminate parts in the media feed system by using a part for more than one function.

SUMMARY

The present application is directed to methods and devices for determining the absence of media sheets within an image forming device. In one embodiment, a support section configured to hold a stack of media sheets is positioned in an input area of the image forming device. A pick mechanism is positioned to contact a top-most sheet in the support section. The pick mechanism may include a pick motor and a pick roller. A sensor roller may be positioned to contact the top-most media sheet at a position spaced away from the pick miter. A controller may determine the absence of a media sheet based on the movement of the sensor roller after a predetermined movement of the pick motor.

DETAILED DESCRIPTION

The present application is directed to methods and devices for detecting when no media is present in an input area of an image forming device. The input area may include a support section to contain a stack of media sheets. A pick mechanism may also be located in the input area. The pick mechanism may include a pick roller that may be in contact with a top-most media sheet in the media stack. The pick mechanism may also include a pick motor to drive the pick roller and a pick motor sensor that senses rotational movement of the pick motor. The pick roller may initiate movement of the top-most sheet of the media stack. The input area may also include a media sheet sensor roller that may be positioned to also contact the top-most media sheet. The media sheet sensor roller may be separate from the pick roller and pick motor sensor. The media sheer sensor roller senses movement of the top-most media sheet as the media sheet is moved in response to rotation of the pick roller. A controller may oversee the operation of the input area. The controller may send signals to the pick roller motor to start and stop rotation, and receive signals from the sensors. The controller may be configured to determine when there is no media sheet in the supped section by comparing a signal from the pick motor sensor with a signal from the media sheet sensor roller.

Figure 1:
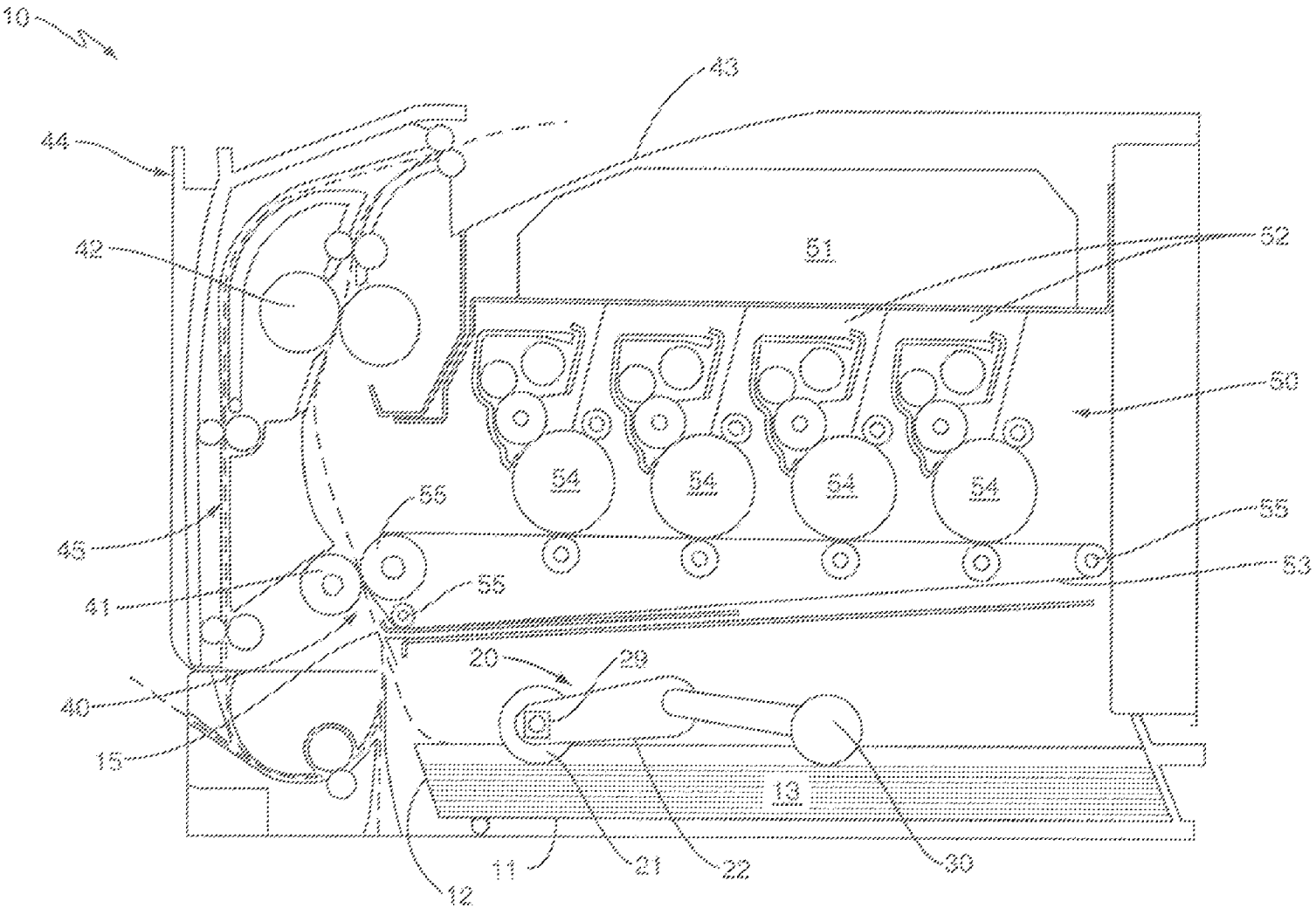
FIG. 1 is a schematic view illustrating an image forming device according to one embodiment.

One embodiment of an image forming device is illustrated in FIG. 1. A control panel 44 may be positioned on an exterior surface of an image forming device 10. Commands may be entered through the control panel 44 to control the operation of the image forming device 10. For example, commands to switch modes (e.g., color mode, monochrome mode), view the number of images printed, take the device 10 on/off line to perform periodic maintenance, and the like may be entered. The control panel 44 may also include a display panel.

The device 10 may include an input area that includes a support section 11 sized to contain a stack of media sheets 13. A pick mechanism 20 may be positioned at the support section 11 for moving the top-most sheet from the stack 13 along the ramp 12 and into the media path 15. Pick mechanism 20 may include an aim 22 and a pick roller 21. The arm 22 may be pivotally mounted to maintain the pick roller 21 in contact with the top-most media sheet. The pick mechanism 20 may include a clutch 28 that affects the movement of the pick roller 21. In one specific embodiment, the clutch 29 is a ball clutch as disclosed in U.S. patent application Ser. No. 10/436,406 entitled "Pick Mechanism and Algorithm for an image Forming Apparatus" filed on May 12, 2003, and herein incorporated by reference. The media sheets from the support section 11 are moved along the media path 15 to a second transfer area 40 where they receive a toner image from an image formation area 50.

The image formation area 50 includes a laser printhead 51, one or more image forming units 52, and a transfer member 53. The laser printhead 51 includes a laser that discharges a surface of photoconductive members 54 within each of the image forming units 52. Toner from a toner reservoir is attracted to the surface area affected by the laser printhead 51. In one embodiment, the toner reservoirs (not shown) are independent of the image forming units 52 and can be removed and replaced from the device 10 as necessary. In another embodiment the toner reservoirs am integral with the image forming units 52. In one embodiment, the device 10 includes four separate image forming units 52 each being substantially the same except for the color of the toner. In one embodiment, the device 10 includes image forming units 52 for use with black, magenta, cyan, and yellow toner.

The transfer member 53 extends continuously around a series of rollers 55. The transfer member 53 receives toner images from each of the photoconductive members 54 and moves the images to the second transfer area 40 where the toner images are transferred to the media sheet. In one embodiment, the toner images horn each of the photoconductive members 54 are placed onto the transfer member 53 in an overlapping arrangement. In one embodiment, a multi-color toner image is formed during a single pass of the transfer member 53.

The second transfer area 40 includes a nip formed by a second transfer roller 41 and roller 55. A media sheet is moved along the media path 15 through the nip and receives the toner images from the transfer member 53. The media sheet with the toner images next moves through a fuser 42 to adhere the toner images to the media sheet. The media sheet is then either discharged into an output tray 43 or moved into a duplex path 45 for forming a toner image on a second side of the media sheet. Examples of the device 10 include Model Nos. C750 and C752, each available from Lexmark International Inc. of Lexington, Ky., USA. In another embodiment, the device 10 is a mono printer comprising a single image forming unit 52 for forming toner images in a single color.

Figure 2:
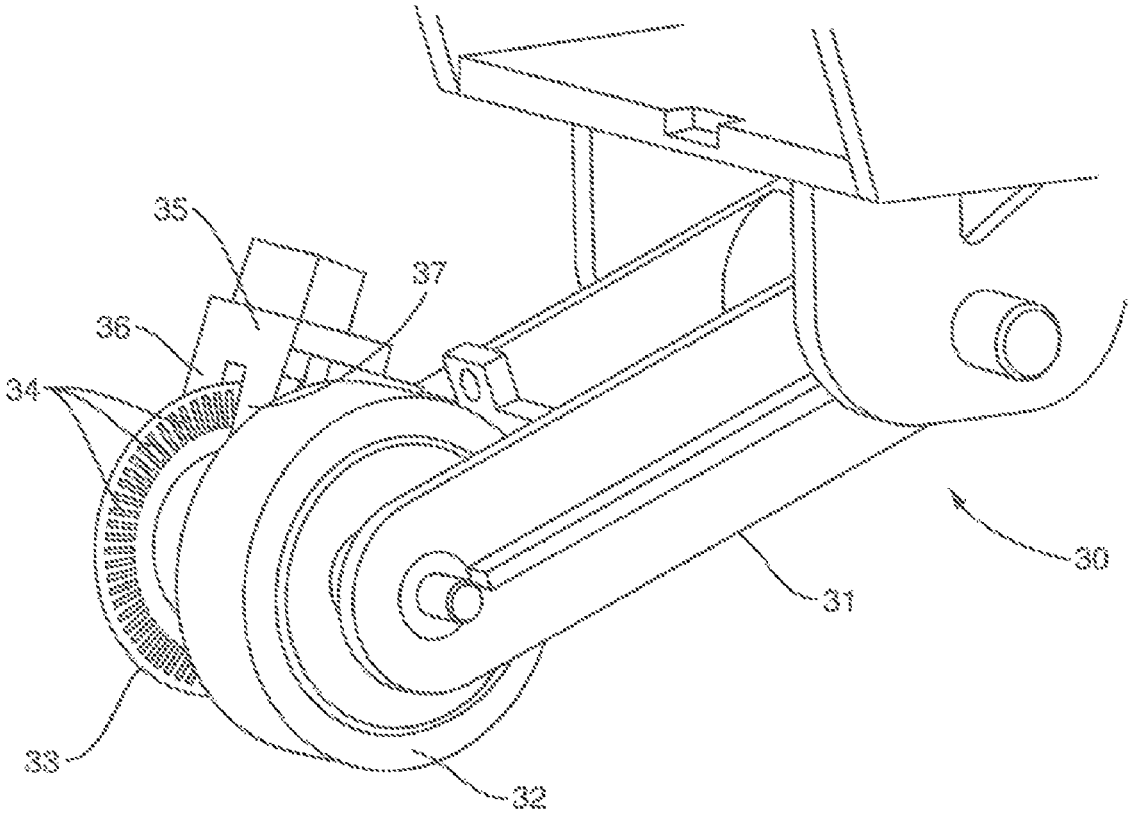
FIG. 2 is a perspective view illustrating a sensor roller according to one embodiment.

As illustrated in FIG. 1, a media sheet sensor 30 is positioned at the support section 11 to determine the movement of the media sheet. As best illustrated in FIG. 2, the media sheet sensor 30 includes an arm 31 that is pivotally attached to a body of the device 10. A media sheet sensor roller 32 is positioned towards an end of the arm 31 and remains in contact with the top-most media sheet in the support section 11. A media sheet sensor wheel 33 is operatively connected to rotate with the media sheet sensor roller 32. The media sheet sensor wheel 33 includes a plurality of indicators 34, such as apertures or printed lines, spaced along the circumference of the media sheet sensor wheel 33. In one embodiment, each indicator 34 has a substantially rectangular shape and is positioned around a center of the media sheet sensor wheel 33 similar to spokes of a wheel. In one embodiment, each indicator 34 is substantially the same size and evenly spaced from the other indicators 34. In another embodiment the indicators 34 have a plurality of different shapes and sizes, and may be located at different positions along the media sheet sensor wheel 33.

A media sheet sensor detector 35 detects rotational movement of the media sheet sensor wheel 33. In one embodiment, the media sheet sensor detector 36 includes an emitter 36 and a receiver 37. In one embodiment, emitter 30 emits an optical signal that is detected by the receiver 37. As the media sheet sensor wheel 33 rotates, the indicators 34 move past the emitter 36 and cause the signal to pass to the receiver 37. Likewise, the other sections of the media sheet sensor wheel 33 move past the emitter 36 and prevent the signal from passing to the receiver 37. A controller 100 (FIG. 4) counts the number of signals and the frequency of the signals to determine the speed and location of the media sheet.

The emitter 36 may generate any color or intensity of light. The emitter 36 may generate monochromatic and/or coherent light, such as for example, a gas or solid-state laser. Alternatively, the emitter 36 may emit non-coherent light of any color or mix of colors, such as any of a wide variety of visible-light, infrared or ultraviolet light emitting diodes (LEDs), or incandescent bulbs. In one embodiment, the emitter 36 generates optical energy in the infrared range, and may include an infrared LED. The receiver 37 may comprise any sensor or device operative to detect optical energy emitted by the emitter 36. In one specific embodiment, the emitter 36 is an infrared LEO optical emitter and the receiver 37 is a silicon phototransistor optical detector. Various embodiments of the pick roller and sensors are disclosed in U.S. patent application Ser. No. 11/406,579 entitled "Method for Moving a Media Sheet Within an image Forming Device" filed on Apr. 14, 2006 and U.S. patent application Ser. No. 11/406,610 entitled "Devices for Moving a Media Sheet Within an image Forming Device" filed on Apr. 19, 2006, and herein incorporated by reference.

In one embodiment, the detector 35 is a quadrature sensor that provides accurate motion sensing of the sensor roller 32. The detector 35 is able to determine both the relative rotational position, and direction of rotation of the sensor roller 32.

Figure 3:
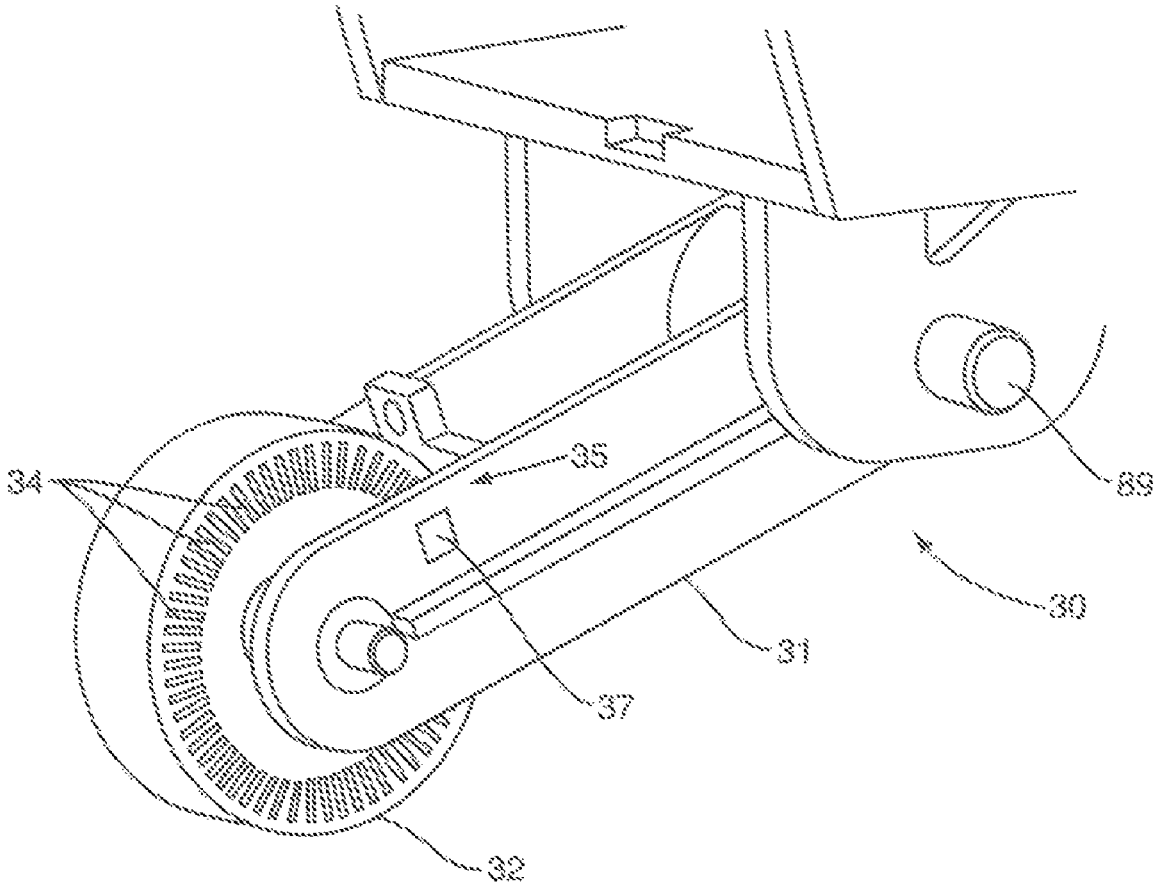
FIG. 3 is a perspective view illustrating a sensor roller according to one embodiment.

FIG. 3 illustrates another embodiment of the media sheet sensor 30. A media sheet sensor roller 32 is rotatably mounted on an arm 31. In this embodiment, the indicators 34 are incorporated onto the media sheet sensor roller 32 rather than on a separate sensor wheel. As the media sheet sensor roller 32 rotates, the indicators 34 move past a sensor 35. The sensor 35 includes an emitter (not shown) and a receiver 37. The media sheet sensor roller 32 is maintained in contact with the top-most media sheet in the support section 11 as the arm 31 pivots about a point 89. When media sheets are present in the support section 11, movement of the top-most media sheet causes the media sheet sensor roller 32 to rotate which is detected by the sensor 35.

FIGS. 2 and 3 illustrate certain embodiments of the media sheet sensors that include various encoder configurations to generate a signal when the encoder rotates. Other examples of sensors that could be used to perform this function include an optical reflective sensor, Hall effect sensor, and a resolver or rotation sensor.

Figure 4:
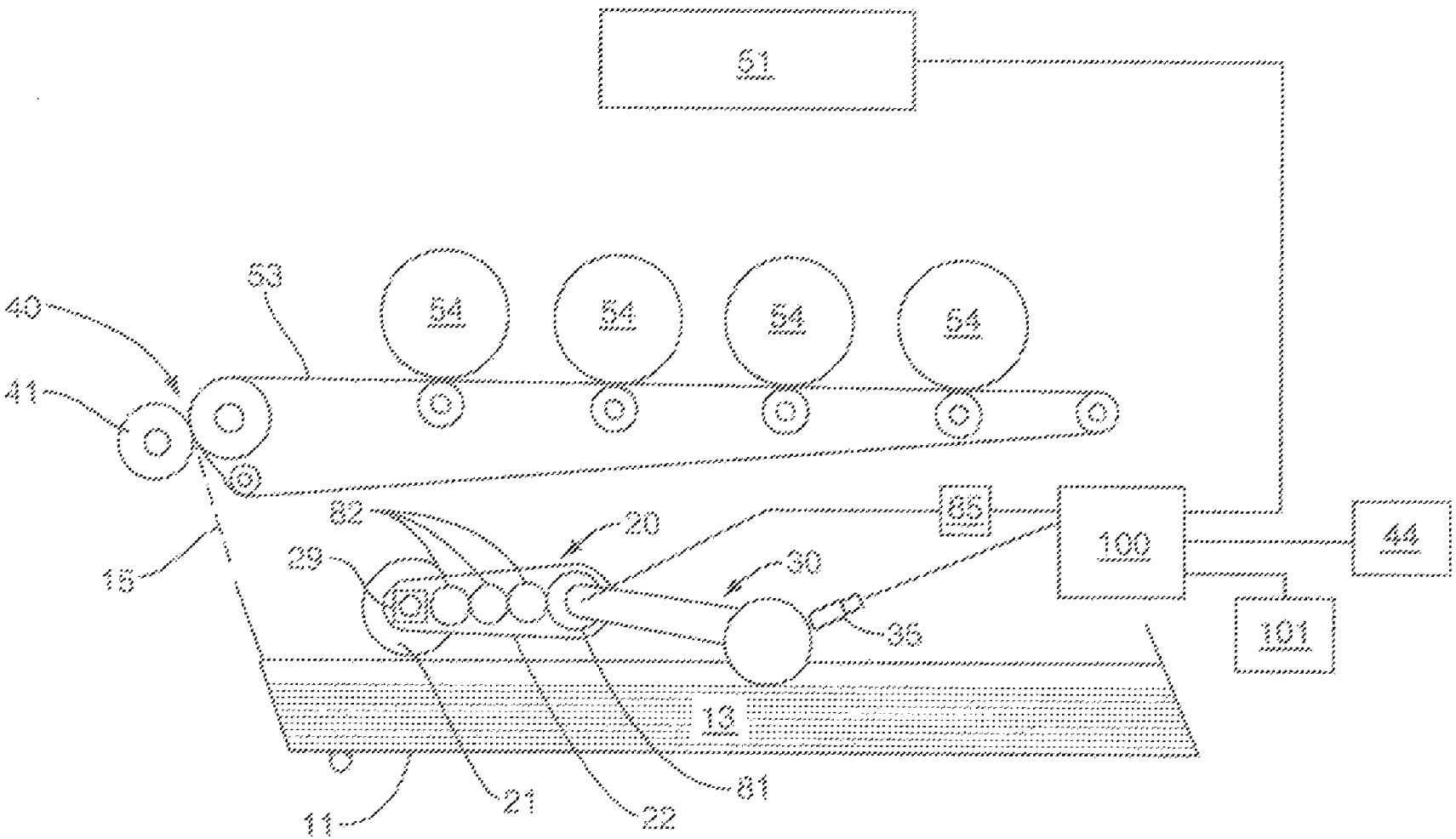
FIG. 4 is a schematic view illustrating a pick mechanism and a sensor roller according to one embodiment.

FIG. 4 illustrates one embodiment of the relationship between the controller 100 and the components of the input area. In one embodiment, controller 100 includes a microprocessor, random access memory, read only memory, and in input/output interface. In one embodiment, controller 100 includes memory 101. In one embodiment, the controller 100 interfaces with the control panel 44. The control panel 44 may be located on an outer surface of the device 10 to facilitate input of commands to control operation of the device 10. The control panel may also facilitate the input of data stored in memory 101 and fodder utilized by the controller 100. In one embodiment, the controller 100 uses data stared in memory 101 to determine whether media is present in the input area.

The pick mechanism 20 may include a pick motor 81 and a pick motor sensor 85. The pick motor sensor 85 senses rotation of the pick motor 81 and sends a signal back to the controller 100. The pick motor 81 may turn one or more gears 82 in a gear train to turn the pick roller 21. Rotation of the pick roller 21 moves a media sheet from the stack 13 into the media path 15. In order to maintain proper spacing of media sheets as they move through the image forming device 10, the controller 100 may cause the pick motor 81 to rotate continuously as media sheets are moved from the media stack 13, or the controller 100 may stop the pick motor 81 after a media sheet moves beyond the pick roller 21. The media sheet sensor 30 is positioned at the supped section 11 to track the movement of the media sheet.

It is known that the pick roller 21 may not begin to rotate immediately once the pick motor 81 begins to rotate. A number of factors may influence the amount of delay between starting rotation of the pick motor 81 and when the pick roller 21 begins to rotate. The pick motor 81 may be connected to the pick roller 21 via one or more gears 82 in the gear train. Due to tolerances in the gear train, there may exist some amount of backlash in the system. The pick motor 81 rotates until the backlash is eliminated. Once the backlash is eliminated, the pick roller 21 begins to rotate. In one embodiment, the pick mechanism 20 includes a clutch 29 that engages to turn the pick roller 21. Delay in clutch 29 engagement or slippage in the clutch 29 may also contribute to the delay between beginning rotation of the pick motor 81 and beginning rotation of the pick roller 21.

Further, there may be a delay once the pick roller 21 begins to rotate and when the media sheet in contact with the pick roller 21 begins to move. The delay in movement of the media sheet may be caused by bouncing of the pick arm 22. As the pick roller 21 begins to rotate, an upward force resulting from rotational forces on the pick roller 21 and frictional forces between the pick roller 21 and the media sheet may be imparted on the pick arm 22. This upward force may result in the pick arm 22 bouncing. The delay in movement of the media sheet may also result from slippage of the pick roller 21.

One or more parameters may be measured to quantify the delay between starting rotation of the pick motor 81 and when the pick roller 21 begins to rotate. For example, empirical testing has been performed to measure a maximum amount of backlash in the gear train, it was then determined how many revolutions of the pick motor 81 are required to eliminate the maximum backlash. In one embodiment, the number of revolutions of the pick motor 81 that occur before rotation of the pick roller 21 begins is in the range horn about 0 to about 15 revolutions. In another embodiment, the delay between starting rotation of the pick motor 81 and when the pick roller 21 begins to rotate is quantified by the amount of time the pick motor 81 has been rotating.

The one or more parameters used to quantify the delay between starting rotation of the pick motor 81 and when the pick roller 21 begins to rotate may be programmed into the controller 100 when the image forming device 10 is Initially built in another embodiment, the parameters am stored in the memory 101. Over a period of time, the values of the parameters may change. For example, as the gears 82 in the gear train wear, the backlash may increase. Therefore, it may be desirable to input new values for the parameters. In one embodiment, the new values are entered into the controller 100 or the memory 101 through the control panel 44. In another embodiment, controller 100 maintains on-going values that are periodically updated.

Figure 5:
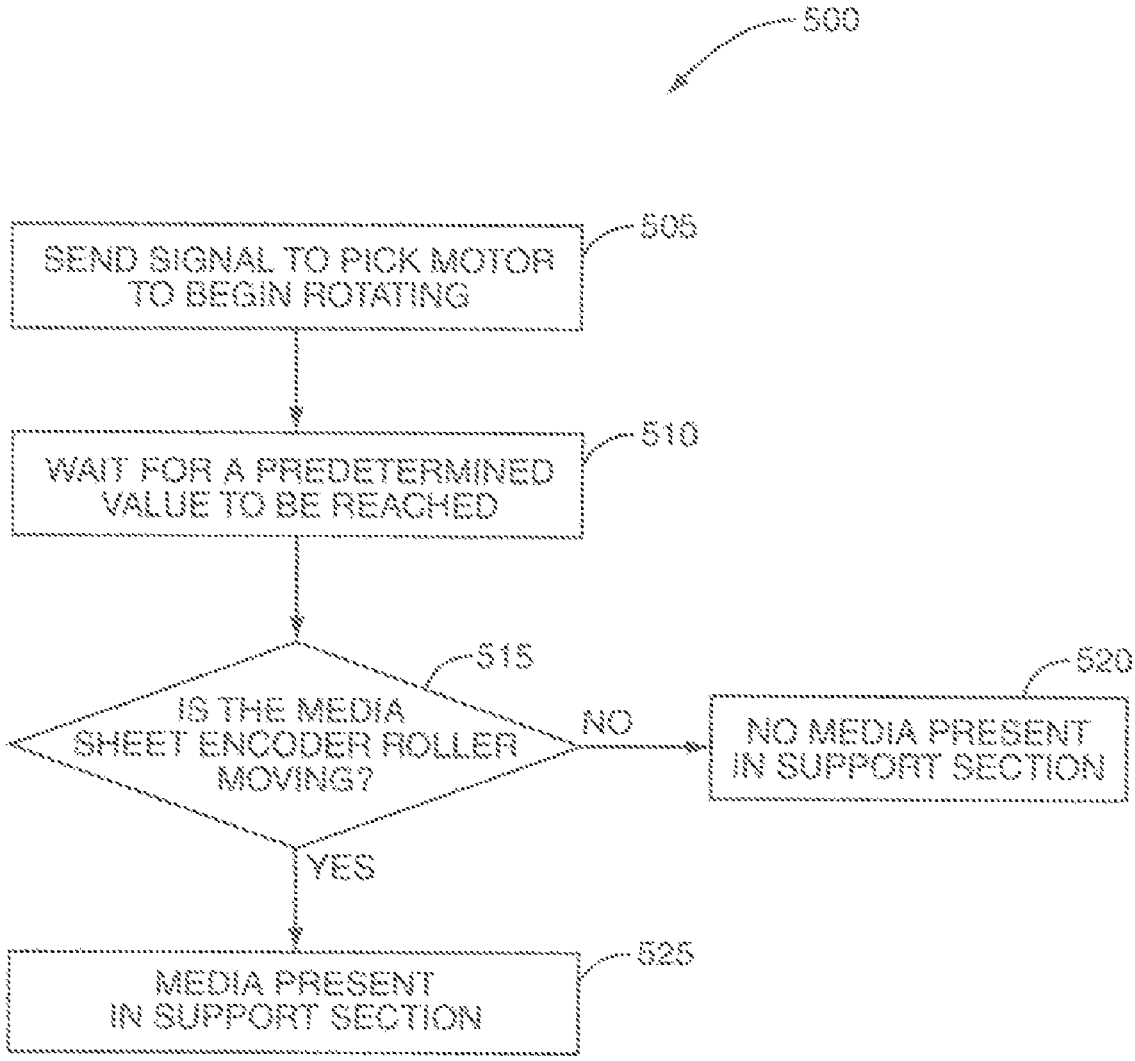
FIG. 5 is a process diagram for a control process according to one embodiment.
Figure 6:
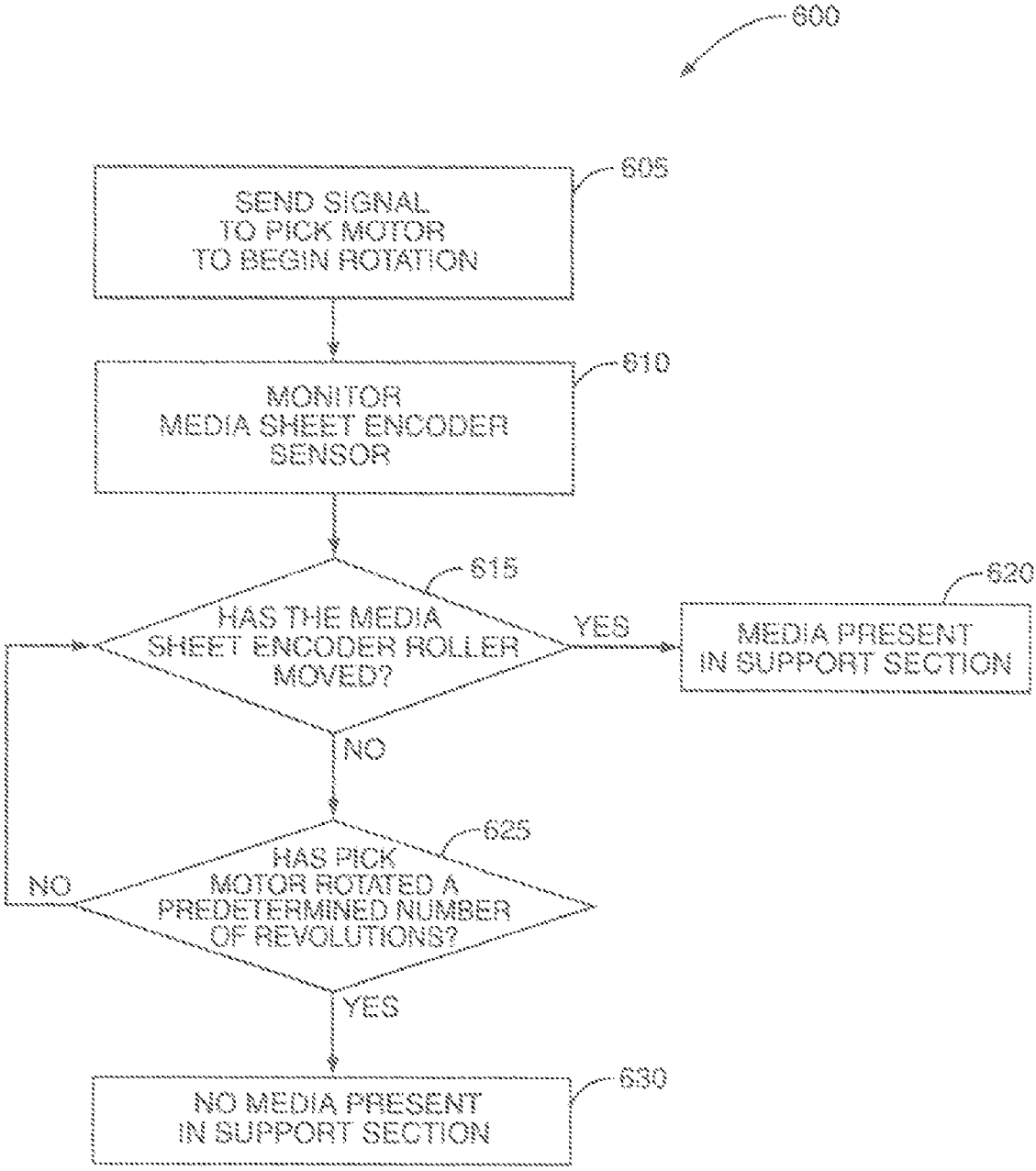
FIG. 6 is a process diagram for a control process according to one embodiment.

In one embodiment, the controller 100 controls the input area according to a process 500 shown in FIG. 5. The controller 100 sends a signal to the pick motor 81 to begin rotating (block 505). The controller 100 determines when a predetermined value has been reached (block 510). As discussed above, this predetermined value may include motor rotations or time. When the predetermined value is reached, the controller 100 then determines whether the media sheet sensor detector 35 has sensed movement of the media sheet sensor roller 32 (block 515). If media is present in the support section 11, then the pick roller 21 will begin to move the top-most media sheet in the stack 13. As the media sheet begins to move, the media sheet sensor roller 32 begins to rotate. The rotation of the media sheet sensor roller 32 is detected by the media sheet sensor detector 35. If the media sheet sensor roller 32 has moved, then the controller determines that media is present in the support section 11 (block 525). If the media sheet sensor roller 32 has not moved, then the controller 100 determines that there is no media present in the support section 11 (block 520).

Figure 8:
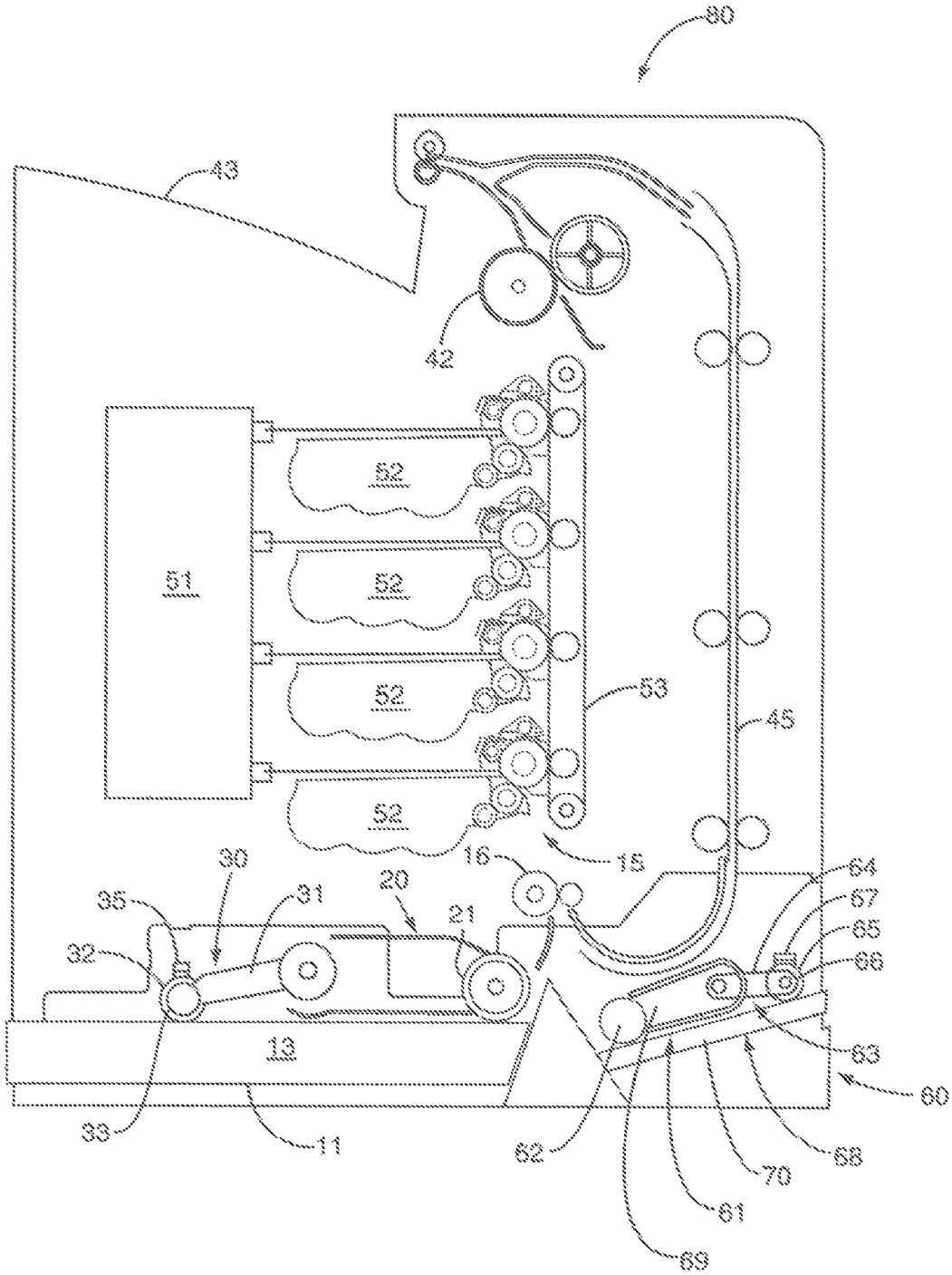
FIG. 8 is a schematic view illustrating an image forming device according to one embodiment.

In one embodiment, the controller 100 controls the input area according to a process 600 shown in FIG. 8. The controller 100 sends a signal to the pick motor 81 to begin rotating (block 605). The controller 100 monitors a signal from the media sheet sensor detector 35 (block 610) to determine whether the media sheet sensor roller 32 has moved (block 615). If no movement has been detected, the controller monitors a signal from the pick motor sensor 85 and determines the number of revolutions of the pick motor 81. Controller 100 then compares the number of revolutions of the pick motor 81 to a predetermined value (block 625). When the predetermined value has been exceeded and no movement of the media sheet sensor roller 32 has been detected, the controller 100 determines that no media is present in the support section 11 (block 630). When movement of the media sheet sensor roller 32 has been detected, the controller 100 determines that media is present in the support section 11 (block 620).

Figure 7:
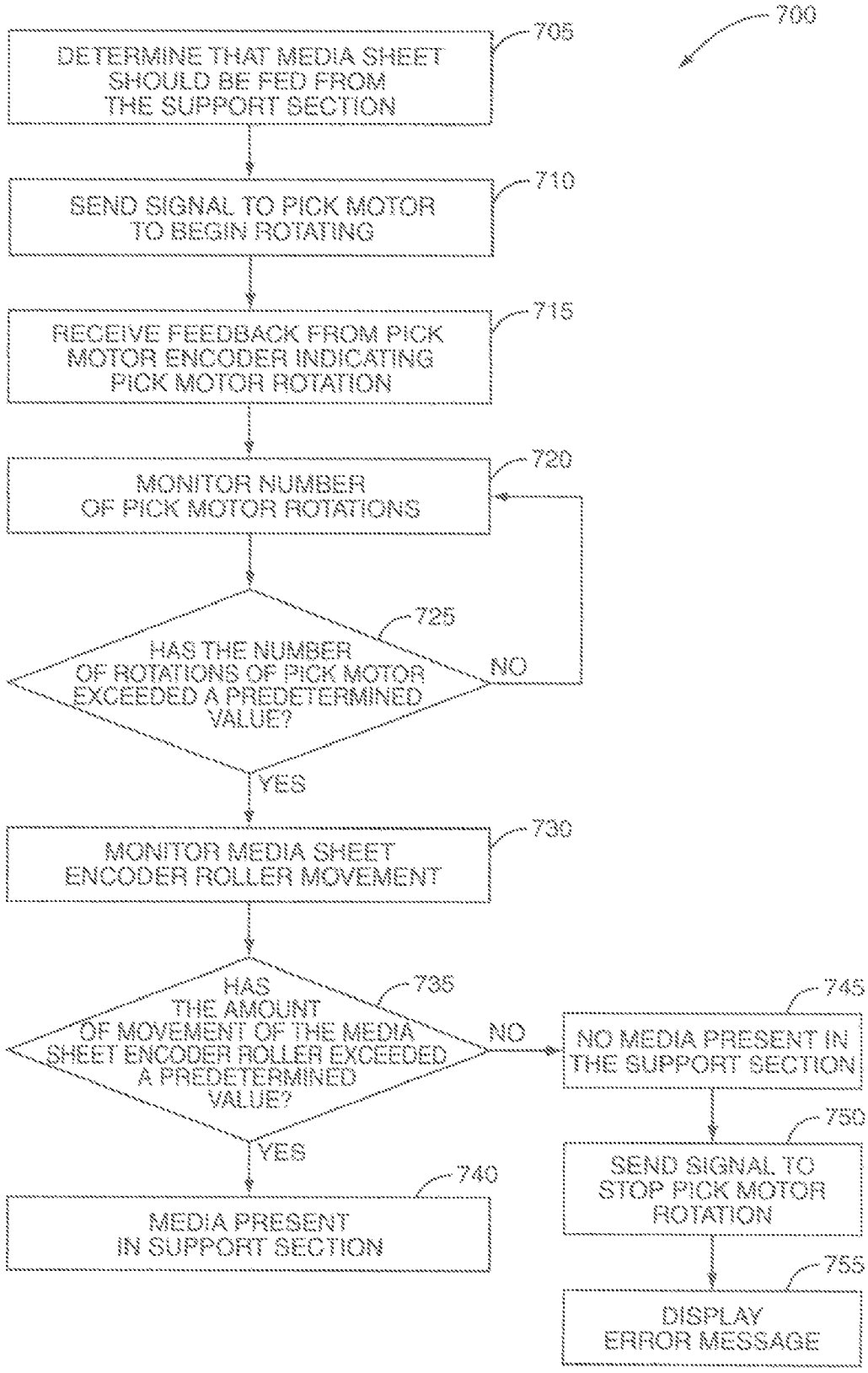
FIG. 7 is a process diagram for a control process according to one embodiment.

In one embodiment the controller 100 controls the input area according to a process 700 shown in FIG. 7. The controller 100 determines that a media sheet should be fed from the support section 11 (block 705). The controller 100 sends a signal to the pick motor 81 to begin rotating (block 710). The pick motor sensor 85 sends a signal back to the controller 100 indicating that the pick motor 81 has begun rotating (block 715). The controller 100 counts the number of revolutions of the pick motor 81 (block 720) and compares the number to a predetermined value (block 725). When the number of revolutions of the pick motor 81 exceeds the predetermined value, the controller 100 then monitors the media sheet sensor roller 32 movement (block 730). The controller 100 determines the amount of movement of the media sheet sensor roller 32 and compares this value to a predetermined amount of movement (block 735). If the predetermined amount of movement has been exceeded, then the controller 100 determines that media is present in the support section 11 (block 740). If the predetermined amount of movement has not been exceeded, then the controller 100 determines that them is no media present in the support section 11 (block 745), Controller 100 then send a signal to the pick motor 81 to stop rotating (block 750) and displays an error message on the control panel 44 (block 755).

It should be noted that the image-forming device 10 illustrated in the previous embodiments is a two-stage image-forming device. In a two-stage transfer device, the toner image is first transferred to a moving transport member 53, such as an endless belt, and then to a print media at the second transfer area 40. However, the present application is not so limited, and may employed a direct transfer image forming device, such as an image forming device 80 shown in FIG. 8.

For the image forming device 80, a pick mechanism 20 picks a top-most media sheet from a media stack 13 located in a support section 11, and feeds it into a media path 15. A media sheet sensor 30 is positioned at the input area and includes an arm 31 including a media sheet sensor roller 32 and a media sheet sensor wheel 33. The media sheet sensor roller 32 is positioned on the top-most sheet in the support section 11. Movement of the top-most sheet causes the media sheet sensor roller 32 to rotate which is then defected by a media sheet sensor detector 35. In one embodiment, media rollers 16 are positioned between the pick mechanism 20 and a first image forming station 52. The media rollers 16 move the media sheet further along the media path 15 towards image forming stations 52, and may further align the sheet and more accurately control the movement in one embodiment, the rollers 16 are positioned in proximity to the input area such that the media sheet remains in contact with the media sheet sensor 30 as the leading edge moves through the rollers 16. In this embodiment, the media sheet sensor 30 monitors the location and movement of the media sheet which can then be used by the controller 100. In another embodiment, the media sheet has moved beyond the media sheet sensor 30 poor to the leading edge reaching the rollers 16.

In one embodiment, the image forming device 80 includes a multipurpose feeder 60 that may be configured to allow feeding of media such as envelopes, post cards, transparencies, or card stock, as well as media that may be too large to fit in the support section 11. The multipurpose feeder 60 may also be used to manually feed media. A pick mechanism 61 picks a top-most media sheet from a media stack 70 in a support section 63 and feeds it into a media path 15. A media sheet sensor 63 is positioned in the input area and includes an arm 64 including a media sheet sensor roller 65 and a media sheet sensor wheel 66. The media sheet sensor roller 66 is positioned on the top-most sheet of the media stack 70. Movement of the media sheet causes the media sheet sensor wheel 66 to rotate which is then detected by a media sheet sensor detector 67. In one embodiment, media rollers 16 are positioned between the pick mechanism 61 and a first image forming station 52. The media rollers 16 move the media sheet further along the media path 15 towards the image forming stations 52, and may further align the sheet and more accurately control the movement. In one embodiment, the rollers 16 are positioned in proximity to the input area such that the media sheet remains in contact with the media sheet sensor 63 as the leading edge moves through the rollers 16. In this embodiment, the media sheet sensor 63 monitors the location and movement of the media sheet which can then be used by the controller 100. In another embodiment; the media sheet has moved beyond the media sheet sensor 63 prior to the leading edge reaching the rollers 16.

The transport member 53 conveys the media sheet past each image-forming station 52. Toner images from the image forming stations 20 are directly transferred to the media sheet. The transport member 53 continues to convey the print media with toner images thereon to the loser 42. The media sheet is then either discharged into the output bay 43, or moved into the duplex path 45 for forming a toner image on a second side of the media sheet.

In one embodiment, the pick roller 21 of the pick mechanism 20 is mounted on a first arm 22, and the media sheet sensor roller 32 is mounted on a second arm 31. In one embodiment, the pick roller 21 is positioned downstream of the media sheet sensor roller 32. In another embodiment, the pick roller 62 of the pick mechanism 61 is mounted on a first arm 60, and the media sheet sensor roller 65 is mounted on a second arm 64. In another embodiment, the pick roller 62 is positioned downstream of the media sheet sensor roller 65.

Figure 9:
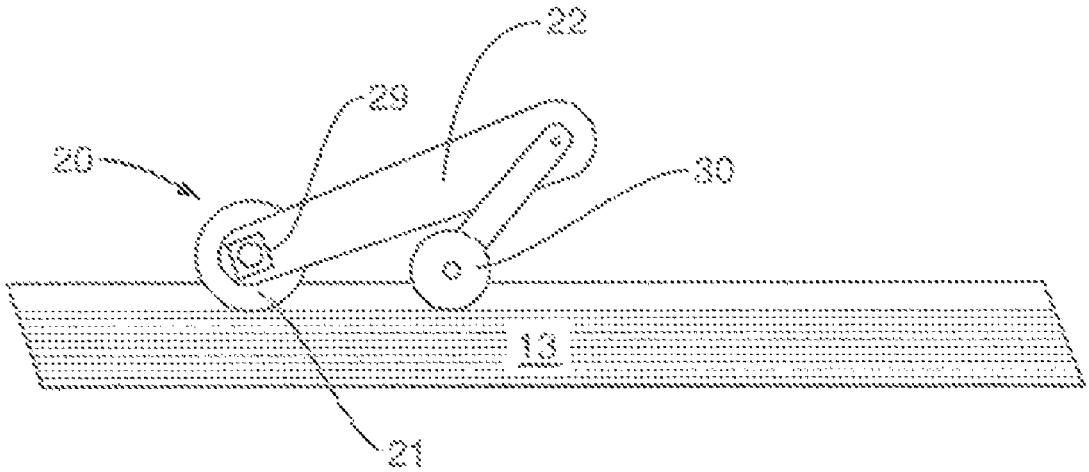
FIG. 9 is a schematic view of a pick mechanism and a sensor roller according to one embodiment.

The above describes methods and devices that rely on the media sheet sensor 30, 63 positioned relative to the pick mechanism 20, 61 on an opposite side of the pick mechanism pivot, as shown in FIGS. 1, 4, and 8. In other embodiments, however, the media sheet sensor 30, 63 may have a different orientation relative to the pick mechanism pivot. In one embodiment, the media sheet sensor 30, 63 may be positioned on the same side of the pick mechanism pivot, as shown in FIG. 9.

Spatially relative terms such as "under", "below", "lower", "over", "upper", and the like, are used for ease of description to explain the positioning of one element relative to a second element. These terms are intended to encompass different orientations of the device in addition to different orientations than those depleted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "composing", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A device to determine the absence of a media sheet at a support section of an image forming device, the device comprising:

a pick mechanism for feeding media sheets from the support section;

a sensor roller for contacting a top-most sheet in the support section, wherein the sensor roller rotates when the top-most media sheet is being fed; and a controller that includes a predetermined delay value of an expected time between when a signal is sent to the pick mechanism to begin rotation and when the pick mechanism actually begins to rotate, the controller further configured to determine that no media sheet is present when the pick mechanism is activated for a predetermined period based on the predetermined delay value and the sensor roller is stationary.

2. The device of claim 1 wherein the pick mechanism comprises a pick roller operatively connected to a pick motor, wherein the pick roller is positioned to contact the top-most sheet at the support section.

3. The device of claim 1 wherein the sensor roller further comprises an encoder configured to rotate with the sensor roller.

4. The device of claim 2 wherein the pick roller is positioned to contact the top-most sheet at a position spaced away from the sensor roller.

5. The device of claim 2 wherein the pick roller is mounted on a first arm and the sensor roller is mounted on a second arm.

6. The device of claim 2 wherein the pick motor and the pick roller are operatively connected by at least one gear.

7. The device of claim 2 further comprising a sensor to detect movement of the pick motor.

8. A method of determining the absence of a media sheet at a support section of an image forming device, the method comprising the steps of:

sending a first signal to a pick motor to begin rotating a pick roller, the pick roller positioned to contact a media sheet at the support section;

receiving a second signal from a sensor roller indicating movement of the media sheet, the sensor roller positioned to contact the media sheet at the support section and at a position spaced away from the pick roller;

determining a time between sending the first signal and when the sensor roller begins rotating;

updating an expected delay period for the pick roller to begin rotating after receiving a signal based on the determined time;

after the media sheet moves beyond the pick roller, sending a third signal to the pick motor to rotate the pick roller; and waiting the expected delay period and determining the sensor roller moves less than a predetermined value after sending the third signal and determining there is no media sheet at the support section.

9. The method of claim 8, further comprising stopping the pick motor after the media sheet moves beyond the pick roller.

10. The method of 9, wherein stopping the pick motor occurs prior to sending the third signal to the pick motor.

11. The method of claim 8, wherein the step of determining no media sheet remains at the support section comprises counting the number of revolutions of the pick motor after sending the third signal to the pick motor.

12. The method of claim 8, wherein the pick roller and the sensor roller are positioned to contact the top-most media sheet at the support section.

13. A method of determining the absence of a media sheet in a support section of an image forming device, the method comprising the steps of:

sending a signal to activate a pick motor at the support section;

monitoring a number of rotations of the pick motor;

monitoring rotation of a sensor roller positioned at the support section and in contact with a top-most sheet of a stack of sheets;

after the number of rotations of the pick motor has exceeded a known rotation amount, determining whether the sensor roller has started rotating; and determining that there is no media sheet at the support section when the sensor roller has not started rotating after the number of rotations of the pick motor has exceeded the known rotation amount.

14. The method of claim 13, wherein the step of sending a signal to activate a pick motor further comprises rotating a pick roller operatively connected to the pick motor.

15. The method of claim 13, wherein the step of sending a signal to activate a pick motor further comprises rotating at least one gear operatively connected to the pick motor.

16. The method of claim 14, further comprising contacting the pick roller with the top-most sheet at the support section.

17. The method of claim 14, further comprising positioning the pick roller at a position spaced away from the sensor roller.

* * * * *